United States Patent [19]

St-Germain

[11] Patent Number: 4,850,453

[45] Date of Patent: Jul. 25, 1989

[54] SCAFFOLDING ATTACHMENT FOR WALL CONSTRUCTION

[76] Inventor: Jean St-Germain, 1350, Rang Saint-Georges, Saint-Simon, Canada, J0H 1Y0

[21] Appl. No.: 270,517

[22] Filed: Nov. 8, 1988

[51] Int. Cl.[4] ..... E04G 5/04

[52] U.S. Cl. ..... 182/229; 182/82; 52/98; 52/513

[58] Field of Search ..... 182/229, 214, 82; 52/513, 379, 98

[56] References Cited

U.S. PATENT DOCUMENTS

| | | | |
|---|---|---|---|
| 2,172,796 | 9/1939 | Krasin | 182/229 |
| 3,026,963 | 3/1962 | Wilkie | 182/229 |
| 3,131,784 | 5/1964 | Jackson | 182/229 |
| 3,403,751 | 10/1968 | Yoder | 182/229 |
| 3,467,418 | 9/1969 | Redditt | 182/229 |
| 3,468,399 | 9/1969 | Lloyd | 182/229 |
| 3,656,580 | 4/1972 | Gostling | 182/229 |
| 3,998,294 | 12/1976 | Moeller | 182/229 |

*Primary Examiner*—Reinaldo P. Machado

[57] ABSTRACT

A scaffolding attachment and method of using the same during construction of an outer wall next to an inner wall. Each attachment consists of a beam adjustably secured to a support post and a bracket element fixed to the inner wall at the same height as the beam. A flat link member is rigidly, permanently secured to the bracket and detachably attached to the beam. The rear portion of the link member is made frangible. The flat link member and flat plate part of the bracket are adapted to be embedded in the mortar between the next-to-highest and the highest building unit at each desired level. Once the mortar has set, the scaffolding beam is detached and the frangible portion of the link member is removed. The outer wall then remains secured to the inner wall thereat and the work platform of the scaffolding may be raised.

8 Claims, 2 Drawing Sheets

SCAFFOLDING ATTACHMENT FOR WALL CONSTRUCTION

FIELD OF THE INVENTION

The present invention relates generally to construction of walls, more specifically to an attachment for temporarily securing a scaffolding to an outer wall and permanently to an adjacent inner wall at desired heights.

BACKGROUND OF THE INVENTION

In the construction of a building having outer walls made of brick, concrete or stone, inner wall frames of wood, for example, covered by plywood or the like are first built. The outer walls are then laid from the ground up by installing scaffolding adjacent thereto to support the workmen as the outer wall rises.

Such scaffolding includes a rigid vertical structure, upon which platforms at selected vertical intervals are supported. The structure may be of elongated wide beams and bars or also in the form of columns or support posts which can carry a vertically-movable platform such as disclosed in my co-pending patent application Ser. No. 563,638 filed Apr. 8, 1988.

Till now, it has been necessary to successively attach and detach such columns and support posts to the inner wall as the outer wall is built up. This method has been laborious and complicated. Moreover, till now, there has been no simple way of determining an accurate consistent spacing between the inner and outer walls.

OBJECTS OF THE INVENTION

In view of the above, it is an important object of the present invention to provide a scaffolding attachment which obviates the above-mentioned disadvantages.

It is another object of the invention to provide a scaffolding attachment of the above type, which is simple in design and very easy to use.

SUMMARY OF THE INVENTION

The above and other objects and advantages of the present invention are realized according to a preferred embodiment comprising a rigid, horizontal beam adjustably secured at one end to a support column or post. The beam is mounted on the support column, so as to extend towards the inner wall of a building along an axis which is normal to the plane defined by such inner wall. To ensure precise positioning of the beam, lateral, axial and vertical adjustment means are preferably provided for the beam.

For each of these beams, there is provided a bracket element which is attachable to the inner wall. The bracket is formed with a flat, horizontal plate rigidly secured thereto and projecting outwardly (rearwardly) of the inner wall. Henceforth, the term "forwardly" means towards the inner wall and "rearwardly" means away from the inner wall.

A link member is adapted to have one end portion secured to the bracket plate by a suitable securing means. The rear end portion is provided with an attachment means by which it can be detachably attached to the other end of the beam. The rear end portion of the link member is made frangible forwardly of the attachment means.

Use of the scaffolding attachment is as follows: the bracket element is fixed to an inner wall; the link member is secured to the horizontal plate and to the horizontal beam.

Each bracket element is attached to the inner wall at a selected height, so that the horizontal plate and the link member extend over and slightly above the upper surface of the next-to-highest building unit (brick or stone) to be laid on the outer wall before raising the platform. Thus, when the workmen reach such upper surface, mortar is applied under and over the plate and link member, on the upper surface of the next-to-highest brick and the highest brick or stone of that level is put in place. When the mortar has set, the platform is ready to be raised and the beam is detached from the link member. The last step in the procedure is to break off the rear end portion of the striplike link member by simply using a suitable tool. Thus, the plate and the link member are embedded in the mortar between the two bricks or stones. The plate remains rigidly secured to the inner wall, thus providing accurate spacing between the two walls and, at the same time, strengthening the outer wall. Up until such time, during construction, as the outer wall reaches the horizontal plane of the bracket element plate, the scaffolding remains securely attached to the inner wall.

BRIEF DESCRIPTION OF THE DRAWINGS

The foregoing will be more clearly understood by having referral to the preferred embodiment of the invention, illustrated by way of the accompanying drawings, in which.

Like numerals indicate like elements throughout the drawings.

DETAILED DESCRIPTION OF THE PREFERRED EMBODIMENT

Figure 1:
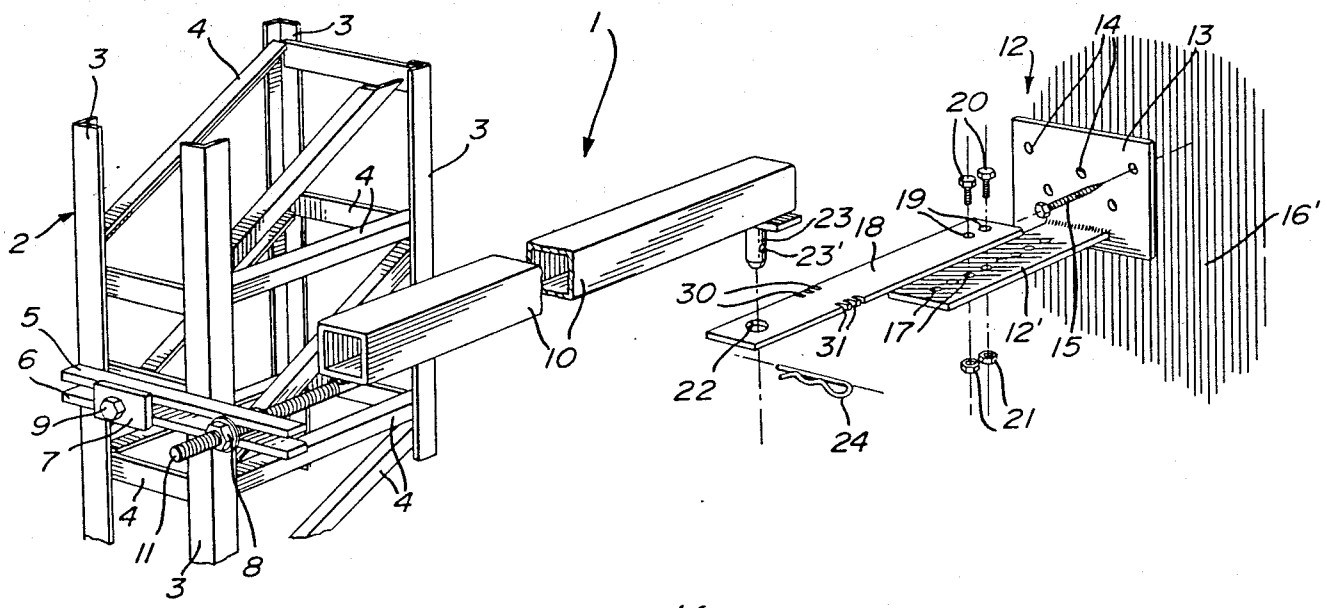
FIG. 1 is a partially-exploded perspective view of the preferred embodiment of the invention.

In FIG. 1 is shown the attachment of the invention, generally designated at 1. The left portion of the drawing depicts a support scaffolding post 2, consisting of four vertical angle irons 3 and a plurality of bars 4 forming the framework thereof. Post 2 (along with others not shown) is adapted to support a vertically-displaceable platform (also not shown), and a pair of closely vertically-spaced flat bars 5,6 secured to post 2 by a bolt 9 and small plate 7. Immediately inside the inside corner iron 3, an elongated threaded rod 11 is adjustable held in place by a pair of nuts 8 (only one of which is visible). An elongated beam 10, preferably hollow, is welded or otherwise secured to the forward portion of elongated rod 11, so that the rod 11 and beam 10 are oriented along parallel axes.

Figure 2:
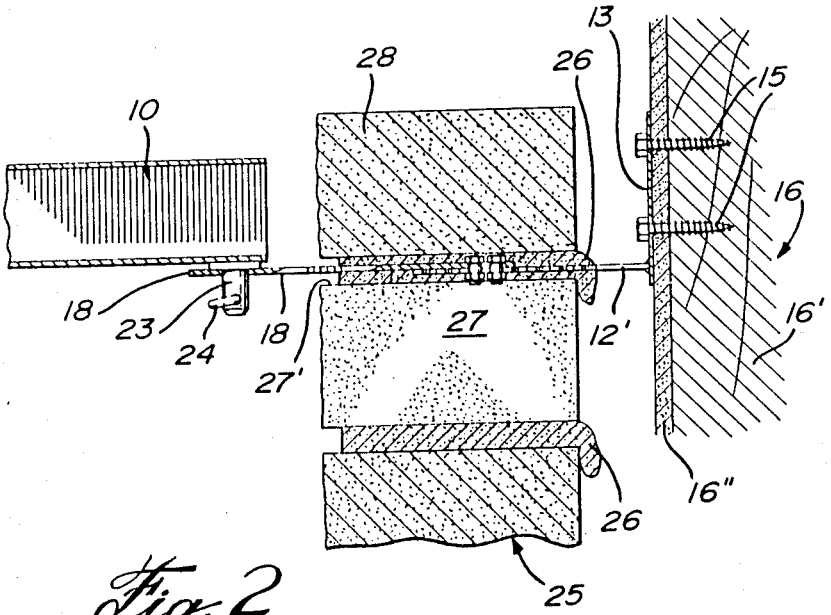
FIG. 2 is a cross-sectioned lengthwise elevation of the invention of FIG. 1.

The above arrangement allows beam 10 to tbe adjusted laterally, vertically and along the direction of its axis. It will be clear that bolt 9 and plate 7 constitute the vertical adjustment means disclosed above. since bars 5 and 6 may be pivoted about bolt 9 and locked in the desired position. The lateral adjustment means of beam 10 is embodied by nuts 8: they are loosened to move rod 11 laterally, then thightened to lock rod 11 in position. In order to adjust beam 10 forwardly or rearwardly, the beam need only be screwed forwardly or rearwardly and, similarly, tightened at a desired position by nuts 8. Adapted to be rigidly, permanently secured to the inner wall 16 are a plurality of vertically-spaced brackets elements, one of which is shown in the drawings at 12. Each element 12 consists of an upright part 13 having perforations 14 through which screws 15 secure the part to the inner wall 16. The latter, as seen in FIG. 2, is commonly made of wood studs 16' covered by a layer of plywood 16'' or the like.

Each bracket 12 is further formed with a rearwardly-extending flat, rigid horizontal plate 12' having a plurality of forwardly, rearwardly- i.e. lengthwisely-spaced holes 17.

The plate 12' is adapted to rigidly retain a thin, flat, rigid link member 18, having a forward portion and a rear portion. The forward portion is provided with a securing means, consisting of a pair of holes 19 adapted to overly in registry any pair of holes 17. Holes 17 and 19 are secured together by screws 20 and nuts 21. The securing means is thus adjustable, so that the two walls may be properly positioned relative to each other.

The rear portion of the hook member 18 has attachment means to attach it to the front beam 10. The attachment means consists simply of a circular opening 22 made in the rear end of the link 18, and a rigid downwardly-projecting anchoring peg 23 fixed to the forward end of beam 10, peg 23 fitting into opening 22. A lock means is provided to prevent disengagement of beam 10 from link 18 consisting of a pin element 24 adapted to lockingly engage a hole 23' made in peg 23.

Figure 3:
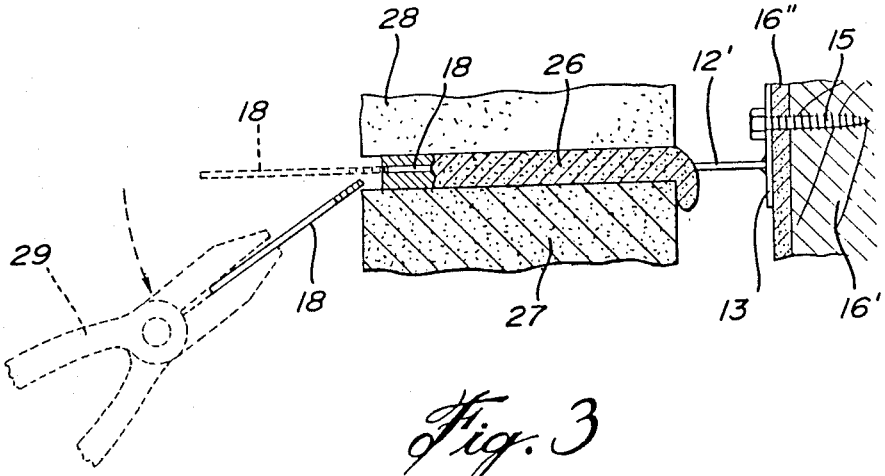
FIG. 3 is another lengthwise cross-sectioned elevation showing the outer wall, a portion of the inner wall and, in dashed outline, a pair of pliers breaking off the frangible outer end portion of the link member.

Referring now to FIG. 1 and particularly to FIGS. 2 and 3, there is shown use of the invention. Firstly, with the work platform raised to the desired height, a bracket element 12 is rigidly, permanently secured to the inner wall 16. Secondly, the link member 18 is secured to plate 12' with an adjustment being made to ensure correct spacing between inner wall 16 and outer wall 25. Thirdly, beam 10 is adjusted to a proper positioning and attached to the rear end of link 18, thereby firmly securing the scaffolding to the inner wall at that height. Fourthly, mortar 26 is applied to the top surface 27' of the next-to-highest brick 27 at that particular height. The mortar 26 will thus completely surround plate 12' and link member 18, as clearly shown in FIG. 2. Fifthly, the last brick 28 is placed in position and the mortar is allowed to set. The sixth step consists in dismantling the attchment means of beam 10 to link member 18. The seventh and last step is shown in FIG. 3. It consists simply in breaking off the rearwardly-projecting portion of link member 18 with a pair of pliers 29. Link 18 has its rearward portion made frangible for this purpose by a pair of laterally-opposite notches 30, 31, preferably three on each side. The link is made such that the remaining portion of link 18 is entirely hidden within mortar 26, thereby providing an aesthetic finish.

It is to be noted that outer walls, up to 200 feet high, may be constructed in using the present invention.

What I claim is:

1. A scaffolding attachment for wall construction wherein the wall includes an outer wall and an inner wall, comprising: a vertical support structure for a work platform; at least two elongated beams, each secured to said support structure and projecting forwardly, normally towards said inner wall, a corresponding bracket element for each beam secured to said inner wall and having a horizontal plate projecting rearwardly therefrom; a corresponding flat link member adapted to be secured by a securing means to said bracket and having a frangible rear portion and having rearmost attachment means for attachment to the forward end of each said beam, whereby the vertical support structure is temporarily attachable to said inner wall, said plate and said link member being adapted to be permanently embedded in the mortar between the next-to-highest and the highest building unit of said outer wall at each level of said platform and when frangible rear portion is removed, after detachment of said beam, said outer wall is permanently secured to said inner wall and said work platform can be lifted to the next higher level.

2. A scaffolding attachment as defined in claim 1, wherein said support structure includes a plurality of posts supporting a movable platform.

3. A scaffolding attachment as defined in claim 2, wherein each said beam is provided with lateral, axial and vertical adjustment means.

4. A scaffolding attachment as defined in claim 3, wherein each said lateral, axial and vertical adjustment means comprises a pair of vertically-spaced flat bars secured to each said post by a small plate and a bolt, an elongated threaded rod releasably secured between said flat bars at one end by a pair of nuts and secured to said beam at its opposite end, said beam and said rod being oriented along parallel axes.

5. A scaffolding attachment as defined in claim 3, wherein said bracket element is comprised of an upright part fixable to said inner wall, said horizontal plate having a plurality of lengthwisely-spaced holes.

6. A scaffolding attachment as defined in claim 5, wherein said link member securing means consists of a pair of holes adapted to overly in registry any pair of said holes of the horizontal plate; a pair of screws and a pair of nuts, said screws adapted to extend through each of the two pairs of holes in registry.

7. A scaffolding attachment as defined in claim 6, wherein said link member attachment means consists of a circular opening at the rear end of said link member and a rigid downwardly-projecting anchoring peg fixed to the forward end of said beam; said peg being adapted to fit into said circular opening; lock means to releasably prevent disengagement of said beam from said link.

8. A method of temporarily attaching a scaffolding support structure to a building inner wall, for the purpose of building an outer wall by the use of an attachment; said attachment including a rigid horizontal beam projecting towards said inner wall; a bracket element secured to said inner wall and having a horizontal plate projecting rearwardly therefrom; a flat link member having a forward portion secured to said plate and a rear portion detachably attached to said beam; said rear portion being frangible; the method comprising the following steps:

(a) the work platform is raised to a desired height and a said bracket element is rigidly secured to said inner wall thereat;
(b) said link member is permanently secured to said bracket element;
(c) said beam is detachably attached to said link member;
(d) mortar is applied to the top surface of the next-to-highest building unit at said height, thereby embedding said link member and said plate;
(e) the highest building unit is placed in position at said height and said mortar is allowed to set;
(f) said beam is detached from said link member; and
(g) said rear portion of said link member is broken off.

* * * * *